US011640134B2

(12) United States Patent
Okazaki

(10) Patent No.: US 11,640,134 B2
(45) Date of Patent: May 2, 2023

(54) SERVER APPARATUS THAT CALCULATES RESIDUAL SERVICE LIFE OF REPLACEABLE UNIT ON BASIS OF OBSERVATION DATA ACQUIRED FROM IMAGE FORMING APPARATUS, RESIDUAL SERVICE LIFE PREDICTION SYSTEM, AND IMAGE FORMING APPARATUS

(71) Applicant: KYOCERA Document Solutions Inc., Osaka (JP)

(72) Inventor: Yuya Okazaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/861,537

(22) Filed: Jul. 11, 2022

(65) Prior Publication Data

US 2023/0024075 A1 Jan. 26, 2023

(30) Foreign Application Priority Data

Jul. 20, 2021 (JP) ..... JP2021-120052

(51) Int. Cl.
*G03G 15/00* (2006.01)
*G03G 21/20* (2006.01)
*G03G 21/18* (2006.01)

(52) U.S. Cl.
CPC ..... *G03G 15/553* (2013.01); *G03G 15/5075* (2013.01); *G03G 15/5079* (2013.01); *G03G 15/5083* (2013.01); *G03G 21/1875* (2013.01); *G03G 21/1882* (2013.01); *G03G 21/203* (2013.01)

(58) Field of Classification Search
CPC ..... G03G 15/50; G03G 15/5075; G03G 15/5079; G03G 15/5083; G03G 15/553; G03G 21/1875; G03G 21/1882; G03G 21/203
See application file for complete search history.

(56) References Cited

U.S. PATENT DOCUMENTS 9,400,469 B2 * 7/2016 Nakai ..... G03G 15/0216
9,488,948 B2 * 11/2016 Kitamura ..... B65H 7/02
2018/0120747 A1 * 5/2018 Nakachi ..... G06F 3/1229

FOREIGN PATENT DOCUMENTS

JP 2016057420 A 4/2016

* cited by examiner

*Primary Examiner* — Joseph S Wong
(74) *Attorney, Agent, or Firm* — IP Business Solutions, LLC

(57) ABSTRACT

A server apparatus including a first communication device and a first computing device. The first communication device communicates with an image forming apparatus via a network. The first computing device includes a processor, and acts as a data acquirer, a dimension reduction processor, and a residual service life calculator, when the processor executes a first control program. The data acquirer acquires observation data of a first number of dimensions from the image forming apparatus, via the first communication device. The dimension reduction processor converts the observation data of the first number of dimensions into characteristic data of a second number of dimensions fewer than the first number of dimensions. The residual service life calculator calculates a residual service life of a replaceable unit in the image forming apparatus, on a basis of the characteristic data.

10 Claims, 8 Drawing Sheets

Fig.6

| | DATE | At | Bt | Ct | Dt | Et | Ft | Gt | RESIDUAL SERVICE LIFE (DAYS) |
|---|---|---|---|---|---|---|---|---|---|
| (START OF USE) | 2020/12/1 | 0 | 0.5 | 0 | 0 | 0 | 0.5 | 0.5 | 310 |
| | 2020/12/2 | 0 | 0.5 | 0 | 0 | 0 | 0.5 | 0.5 | 309 |
| | 2020/12/3 | 0 | 0.5 | 0 | 0 | 0 | 0.5 | 0.5 | 308 |
| | 2020/12/4 | 0 | 0.5 | 0 | 0 | 0 | 0.5 | 0.5 | 307 |
| | ⋮ | | | | | | | | |
| | 2021/10/4 | 0.8 | 0.3 | 0.2 | 0.5 | 0.9 | 0.5 | 0.5 | 3 |
| | 2021/10/5 | 0.75 | 0.3 | 0.2 | 0.5 | 0.9 | 0.5 | 0.5 | 2 |
| | 2021/10/6 | 0.75 | 0.2 | 0.22 | 0.5 | 0.9 | 0.5 | 0.5 | 1 |
| (UNIT REPLACEMENT) | 2021/10/7 | 0.8 | 0.3 | 0.22 | 0.5 | 0.9 | 0.5 | 0.5 | 0 |

SERVER APPARATUS THAT CALCULATES RESIDUAL SERVICE LIFE OF REPLACEABLE UNIT ON BASIS OF OBSERVATION DATA ACQUIRED FROM IMAGE FORMING APPARATUS, RESIDUAL SERVICE LIFE PREDICTION SYSTEM, AND IMAGE FORMING APPARATUS

INCORPORATION BY REFERENCE

This application claims priority to Japanese Patent Application No. 2021-120052 filed on Jul. 20, 2021, the entire contents of which are incorporated by reference herein.

BACKGROUND

The present disclosure relates to a server apparatus, a residual service life prediction system, and an image forming apparatus.

Some of existing image forming apparatuses provided with a photoconductor drum are configured to calculate the service life of the photoconductor drum, on the basis of the number of rotations thereof, and correct the calculated service life using temperature and humidity.

SUMMARY

The disclosure proposes further improvement of the foregoing techniques.

In an aspect, the disclosure provides a server apparatus including a first communication device and a first computing device. The first communication device communicates with an image forming apparatus via a network. The first computing device includes a processor, and acts as a data acquirer, a dimension reduction processor, and a residual service life calculator, when the processor executes a first control program. The data acquirer acquires observation data of a first number of dimensions from the image forming apparatus, via the first communication device. The dimension reduction processor converts the observation data of the first number of dimensions into characteristic data of a second number of dimensions fewer than the first number of dimensions. The residual service life calculator calculates a residual service life of a replaceable unit in the image forming apparatus, on a basis of the characteristic data.

In another aspect, the disclosure provides a residual service life prediction system including an image forming apparatus and a server apparatus. The image forming apparatus includes a first communication device, an image forming device, and a first computing device. The first communication device communicates with the server apparatus via a network. The image forming device forms an image on a recording sheet. The first computing device includes a processor, and acts as a data acquirer, a dimension reduction processor, and a controller, when the processor executes a first control program. The data acquirer acquires observation data of a first number of dimensions. The dimension reduction processor converts the observation data of the first number of dimensions into characteristic data of a second number of dimensions fewer than the first number of dimensions. The controller transmits the characteristic data to the server apparatus, via the first communication device. The server apparatus includes a second communication device, and a second computing device. The second communication device communicates with the image forming apparatus via the network. The second computing device includes a processor, and acts as a residual service life calculator, when the processor executes a second control program. The residual service life calculator acquires the characteristic data via the second communication device, and calculates a residual service life of a replaceable unit in the image forming apparatus, on a basis of the characteristic data.

In still another aspect, the disclosure provides an image forming apparatus including an image forming device and a computing device. The image forming device forms an image on a recording sheet. The computing device includes a processor, and acts as a data acquirer, a dimension reduction processor, and a residual service life calculator, when the processor executes a control program. The data acquirer acquires observation data of a first number of dimensions. The dimension reduction processor converts the observation data of the first number of dimensions into characteristic data of a second number of dimensions fewer than the first number of dimensions. The residual service life calculator calculates a residual service life of a replaceable unit in the image forming apparatus, on a basis of the characteristic data.

BRIEF DESCRIPTION OF THE DRAWINGS

FIG. 6 is a table showing an example of learning data;

DETAILED DESCRIPTION

Hereafter, some embodiments of the disclosure will be described, with reference to the drawings.

First Embodiment

Figure 1:
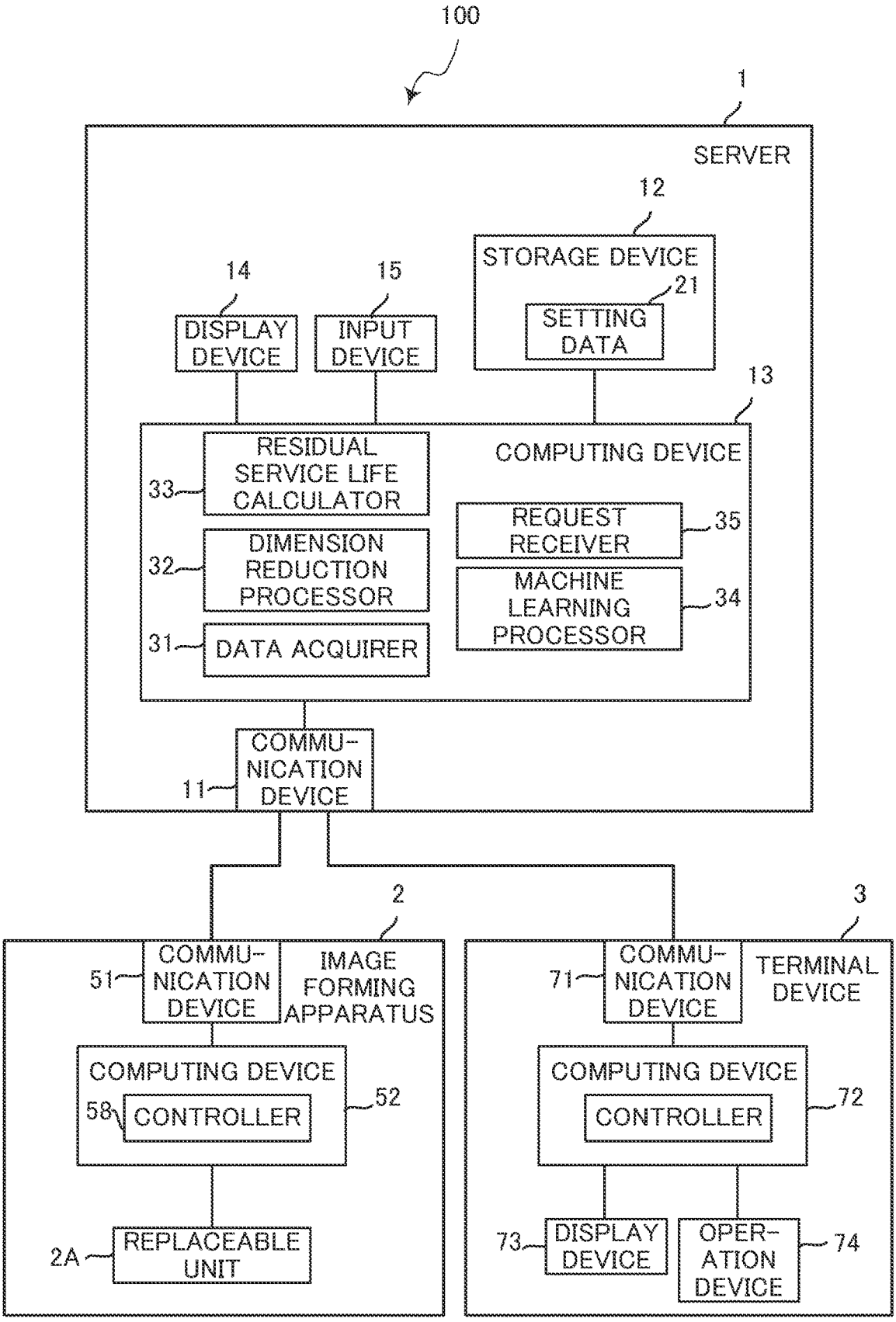
FIG. 1 is a block diagram showing a configuration of a residual service life prediction system according to a first embodiment of the disclosure.

FIG. 1 is a block diagram showing a configuration of a residual service life prediction system 100 according to a first embodiment of the disclosure. The residual service life prediction system 100 includes a server 1, an image forming apparatus 2, and a terminal device 3, as shown in FIG. 1. The server 1 is a computer acting as a server machine, in which various software programs are installed. The server 1 is a device independent from the image forming apparatus 2. The server 1 is configured to perform data communication with one or a plurality of image forming apparatuses 2, and the terminal device 3, via a network such as a local area network (LAN) or the internet.

(1) Configuration of Image Forming Apparatus 2

Figure 2:
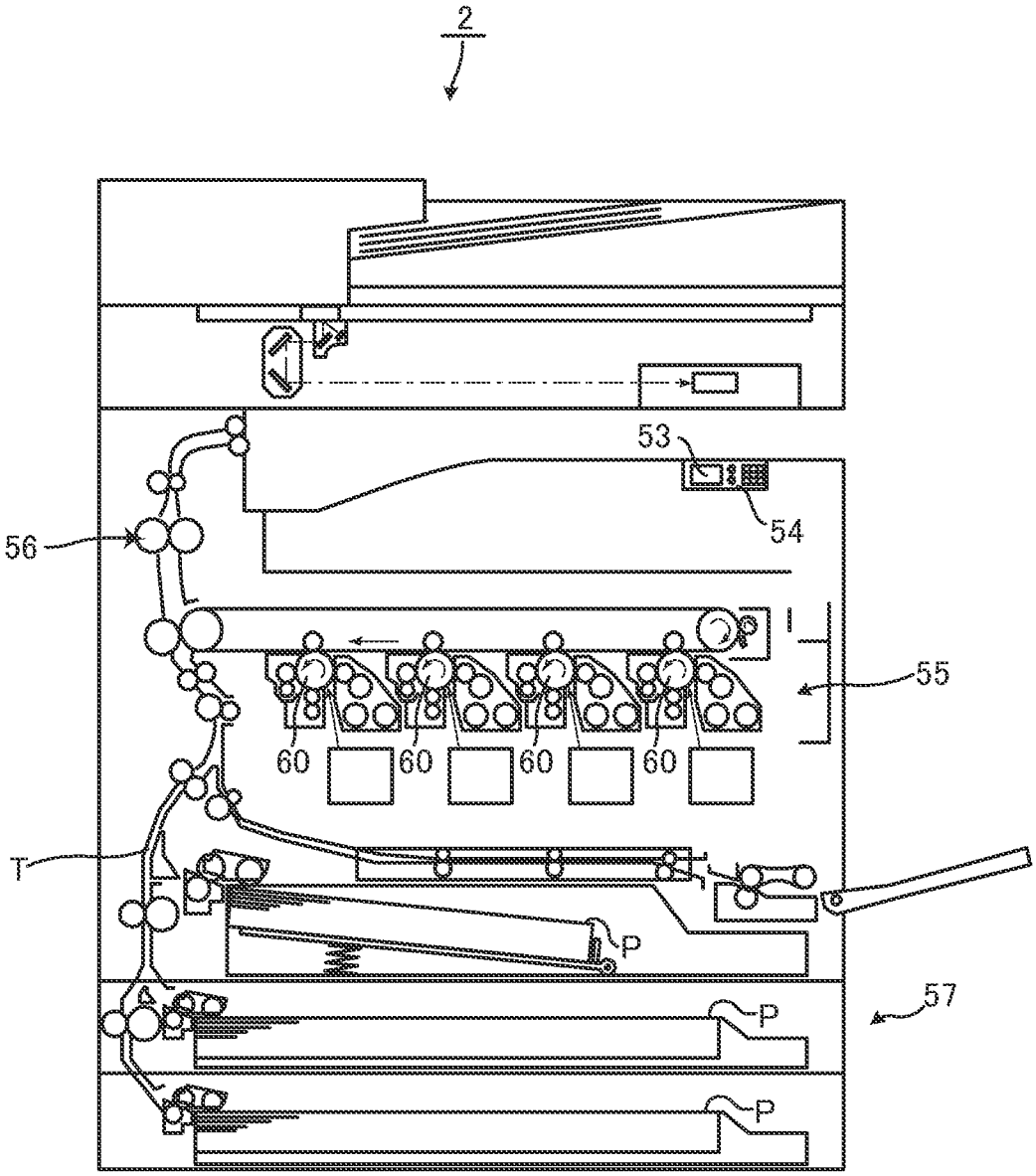
FIG. 2 is a front cross-sectional view showing a structure of an image forming apparatus.

The image forming apparatus 2 includes, as shown in FIG. 1, a replaceable unit 2A, a communication device 51, and a computing device 52. The image forming apparatus 2 also includes, as shown in FIG. 2, a display device 53, an operation device 54, an image forming device 55, a fixing device 56, and a paper feeding device 57.

The communication device 51 includes a communication module such as a LAN board. The communication device 51 performs data communication with the server 1, via the network.

The computing device 52 is a computer including a central processing unit (CPU), random-access memory (RAM), and a read only-memory (ROM). The computing device 52 acts as a controller 58, when the CPU executes a control program, for example stored in the ROM. The controller 58 transmits observation data of a first number of dimensions, which will be subsequently described, to the server 1 via the communication device 51.

The display device 53 displays, to the user, various screens related to the functions that the image forming apparatus 2 is configured to perform. To the operation device 54, instructions of the user are inputted.

The image forming device 55 includes a photoconductor drum 60, a charging device, an exposure device, a developing device, and a transfer device, each exemplifying a replaceable unit 2A. The image forming device 55 forms an image represented by a toner image, on a recording sheet P transported by a transport roller pair, along a transport route T.

The fixing device 56 heats and presses the recording sheet P on which the toner image has been formed, to thereby fix the toner image onto the recording sheet P The recording sheet P, with the toner image fixed thereon by the fixing device 56, is delivered to an output tray.

The paper feeding device 57 draws out the recording sheets P stored in a paper cassette or a manual bypass tray, with a pickup roller one by one, and delivers the recording sheet P to the transport route T.

(2) Configuration of Terminal Device 3

As shown in FIG. 1, the terminal device 3 includes a communication device 71, a computing device 72, a display device 73, and an operation device 74.

The communication device 71 includes a communication module such as a LAN board. The communication device 71 performs data communication with the server 1, via the network.

The computing device 72 is a computer including a CPU, a RAM, and a ROM. The computing device 72 controls operations of the terminal device 3, by loading a program on the RAM and executing the program with the CPU.

The display device 73 displays, to the user, various screens related to the functions that the image forming apparatus 2 is configured to perform. To the operation device 74, instructions of the user are inputted.

(3) Configuration of Server 1

The server 1 is, for example, a cloud server. The server 1 includes a communication device 11, a storage device 12, a computing device 13, a display device 14, and an input device 15.

The communication device 11 includes a communication module such as a LAN board. The communication device 11 performs data communication with external devices connected via the network, such as the image forming apparatus 2 and the terminal device 3. The storage device 12 is a non-volatile memory unit such as a flash memory or a hard disk drive. The storage device 12 contains various programs and data. The storage device 12 stores setting data 21 indicating a result of machine learning, as will be subsequently described.

The computing device 13 is a computer including a CPU, a RAM, and a ROM. The computing device 13 acts as various types of functional units, by loading a program on the RAM and executing the program with the CPU. The display device 14 includes an LCD panel. The display device 14 displays screens exhibiting various types of information, such as an operation screen, to the user. The input device 15 includes a keyboard and a mouse. To the input device 15, instructions of the user are inputted.

To be more detailed, the computing device 13 acts as a data acquirer 31, a dimension reduction processor 32, a residual service life calculator 33, a machine learning processor 34, and a request receiver 35, when the CPU executes a control program, for example stored in the ROM.

The data acquirer 31 acquires, from the image forming apparatus 2, observation data of a predetermined first number of dimensions (N-dimensions composed of observed values of N pieces of items) at a certain time point, to work out a residual service life at the current time, or to acquire learning data of the machine learning to be subsequently described.

The observation data includes respective observed values of a plurality of predetermined observation items, related to the service life of the replaceable unit 2A in the image forming apparatus 2. The data acquirer 31 acquires the observation data for the machine learning from the image forming apparatus 2, periodically or at a predetermined timing (e.g., at the time of calibration), over a predetermined period of time (e.g., from the start of use to the replacement of the replaceable unit 2A).

In the first embodiment, the replaceable unit 2A is exemplified by the photoconductor drum 60 mounted in the image forming device 55. The data acquirer 31 acquires, as the observation data, a plurality of observed values each representing a travel distance Ain of the photoconductor drum 60, density gradation Bin, density difference Cin along the axial direction of the photoconductor drum 60, a coverage rate Din, the number of printed sheets Ein, temperature Fin, and humidity Gin. Thus, the data acquirer 31 acquires the observed values of the seven observation items cited above.

The controller 58 of the image forming apparatus 2 counts and retains the travel distance Ain of the photoconductor drum 60, the coverage rate Din, and the number of printed sheets Ein, acquired from the printing operation executed. The controller 58 also identifies the density gradation Bin, and the density difference Cin along the axial direction of the photoconductor drum 60, for example through density measurement of a patch image, at the time of calibration, and retains such data. Further, the controller 58 acquires the temperature Fin and the humidity Gin each time the observation data is acquired, or constantly monitors the temperature Fin and the humidity Gin.

The travel distance Ain of the photoconductor drum 60 reduces in proportion to the surface film thickness of the photoconductor drum 60. Accordingly, the travel distance Ain is acquired as the observed value correlated with the surface film thickness of the photoconductor drum 60.

The density gradation Bin represents the linearity of toner image density, with respect to designated image density. In this embodiment, the density gradation Bin is obtained through an equation cited below. The linearity of the toner image density with respect to the designated image density fluctuates owing to the wear of the photoconductor drum 60, which is the reason that the density gradation Bin has to be acquired.

$$Bin=\{(XYZ95\%-XYZ85\%)/(95-85)\}/\{(XYZ85\%-XYZ75\%)/(85-75)\}=(XYZ95\%-XYZ85\%)/(XYZ85\%-XYZ75\%)$$

In this equation, the member "XYZn %" represents an XYZ coordinate value at n % (n=95, 85, 75) with respect to the density for solid printing (100%) with the toner color on the photoconductor drum 60.

The density difference Cin along the axial direction of the photoconductor drum 60 represents density deviation along the axial direction of the photoconductor drum 60, arising from the wear of the photoconductor drum 60. In this embodiment, the density difference Cin is obtained through an equation cited below.

$$Cin=(CTD\ \text{front}-CTD\ \text{rear})/CTD\ \text{front}$$

In this equation, the member "CTD front" represents the toner density of predetermined intermediate density on the front end portion (driving side) of the photoconductor drum 60, in the axial direction. "CTD rear" represents the toner density of predetermined intermediate density on the rear end portion of the photoconductor drum 60, in the axial direction.

The coverage rate Din represents an average coverage rate, over the period from the start of use of the photoconductor drum 60 to the time of the observation.

The number of printed sheets Ein represents the use amount of the photoconductor drum 60 for the printing operation. Therefore, the number of printed sheets Ein is acquired separately from the travel distance Ain of the photoconductor drum 60.

The data acquirer 31 normalizes the mentioned observed values, as described below.

The data acquirer 31 normalizes the travel distance Ain of the photoconductor drum 60 into a travel distance At thereof, using the following equation.

$$At=Ain/Amax$$

In this equation, the member "Amax" represents the travel distance at which a wear limit of the surface film thickness of the photoconductor drum 60 is reached.

The density gradation Bin becomes 1, when the gradation is perfectly linear (i.e., when the incline is constant). Accordingly, the data acquirer 31 normalizes the density gradation Bin into density gradation Bt, using the following equation.

$$Bt=Bin-0.5$$

The data acquirer 31 normalizes the density difference Cin along the axial direction of the photoconductor drum 60 into density difference Ct, using the following equation.

$$Ct=(Cin-CTDmin)/(CTDmax-CTDmin)$$

In this equation, the member "CTDmin" represents the toner density deviation Cin in the state where there is no deviation. "CTDmax" represents the toner density deviation Cin in the state where the surface film thickness of the photoconductor drum 60 has reached the wear limit.

The data acquirer 31 normalizes the coverage rate Din, the temperature Fin, and the humidity Gin into a coverage rate Dt, temperature Ft, and humidity Gt, respectively, using the following equation.

$$Dt=(Din-\mu d)/od$$

$$Ft=(Fin-\mu f)/of$$

$$Gt=(Gin-\mu g)/og$$

The members "μd", "μf", and "μg" are the average value of the market data of the coverage rate Din, the temperature Fin, and the humidity Gin, respectively, obtained in advance from the market. The members "od", "of", and "o" represent the standard deviation of the market data of the coverage rate Din, the temperature Fin, and the humidity Gin, respectively.

The data acquirer 31 normalizes the number of printed sheets Ein into the number of printed sheets Et, using the following equation.

$$Et=Ein/Emax$$

The member "Emax" represents the number of printed sheets at which the wear limit of the surface film thickness of the photoconductor drum 60 is reached, in other words the number of sheets at which the durability limit of the photoconductor drum 60 is reached.

The dimension reduction processor 32 converts the observation data of the first number of dimensions acquired by the data acquirer 31 (e.g., three or more dimensions; in this embodiment, seven dimensions composed of the seven items of the observed value), into characteristic data of a second number of dimensions (e.g., one dimension) fewer than the first number of dimensions.

More specifically, the dimension reduction processor 32 converts the observation data of the first number of dimensions into the characteristic data of the second number of dimensions, using a neural network of a learned self-organization map.

The residual service life calculator 33 calculates the residual service life of the replaceable unit 2A (in this embodiment, photoconductor drum 60) in the image forming apparatus 2, on the basis of the characteristic data acquired by the dimension reduction processor 32.

Figure 3:
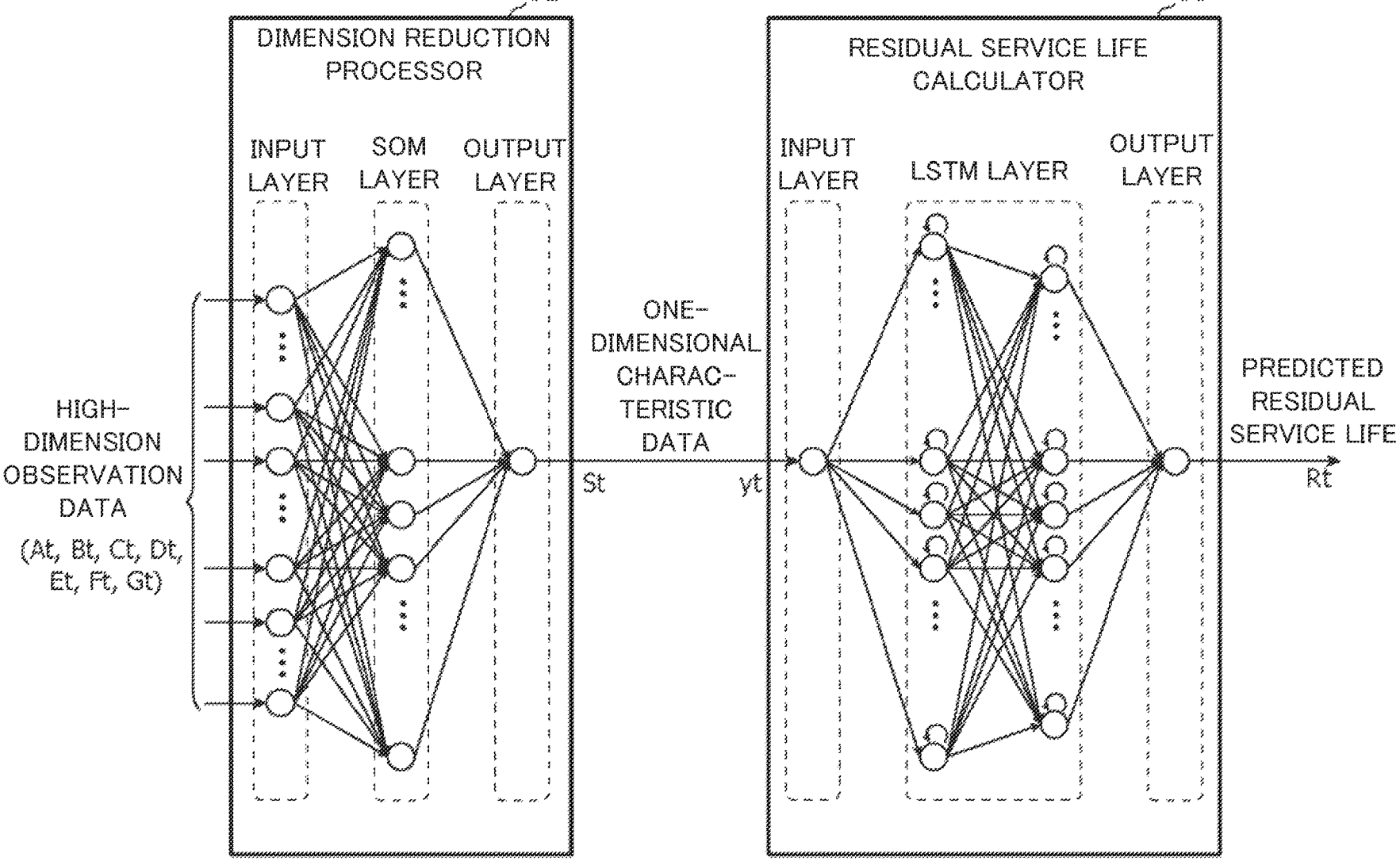
FIG. 3 is a schematic diagram showing an example of a configuration of a dimension reduction processor and a residual service life calculator.

FIG. 3 illustrates an example of the configuration of the dimension reduction processor 32 and the residual service life calculator 33. As shown in FIG. 3, the dimension reduction processor 32 converts the observation data At to Gt of the first number of dimensions into two-dimensional output space data (z1, z2), using a neural network of a self-organization map SOM (tiered neural network including a SOM layer), and outputs a norm L of the two-dimensional output space data (Euclidean distance from the origin of the two-dimensional output space), as the one-dimensional (normalized) characteristic data St. Here, although the dimension reduction processor 32 shown in FIG. 3 outputs the self-organization map SOM to the two-dimensional output space, the dimension reduction processor 32 may output the self-organization map SOM to a one-dimensional output space, and output the one-dimensional output space data as the one-dimensional characteristic data St.

Figure 4:
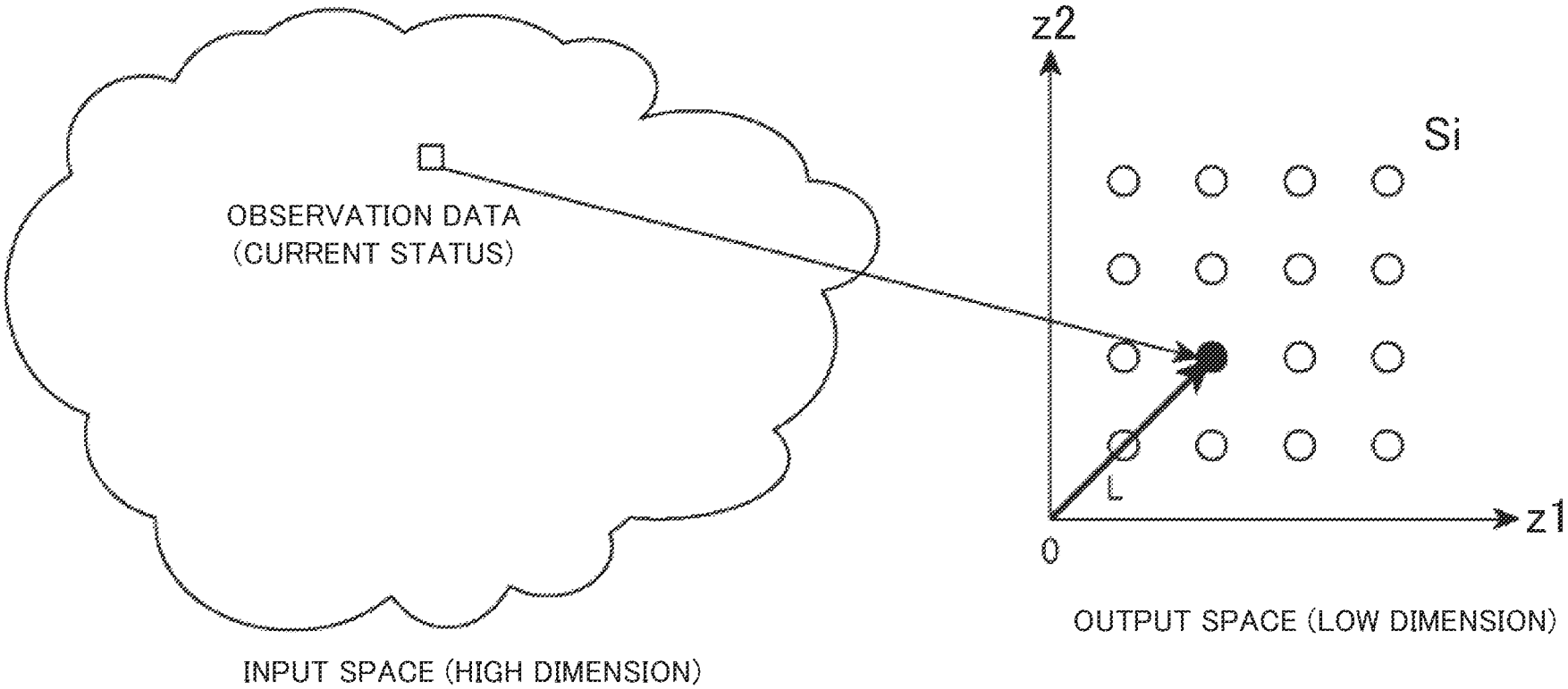
FIG. 4 is a schematic drawing for explaining a self-organization map.

FIG. 4 is a schematic drawing for explaining the self-organization map SOM. In the self-organization map SOM, for example, the output space includes a predetermined number n of nodes 51 to Sn (e.g., 16 nodes in FIG. 3), distributed at predetermined positions. The dimension reduction processor 32 performs mapping from the input space (space of observation data) to the output space, using the mentioned neural network. The dimension reduction processor 32 normalizes the norm L, by dividing by the maximum value of the norm L of the nodes.

In the first embodiment, the residual service life calculator 33 converts the characteristic data St into input data yt using a neural network of long-short term memory (LSTM) (tiered neural network including an LSTM layer), and calculates the residual service life Rt (predicted value) on the basis of the input data yt.

The machine learning processor 34 performs machine learning of the neural network of the self-organization map SOM and the LSTM neural network, using a plurality of sets of learning data, on the basis of a plurality of sets of observation data, acquired for the machine learning over the period from the start of use of the replaceable unit 2A to the time of replacement thereof, each of the plurality of sets of learning data being composed of a combination of the observation data and the residual service life at the time of the observation (e.g., date) (i.e., period from the time of observation to the time of replacement).

Figure 5:
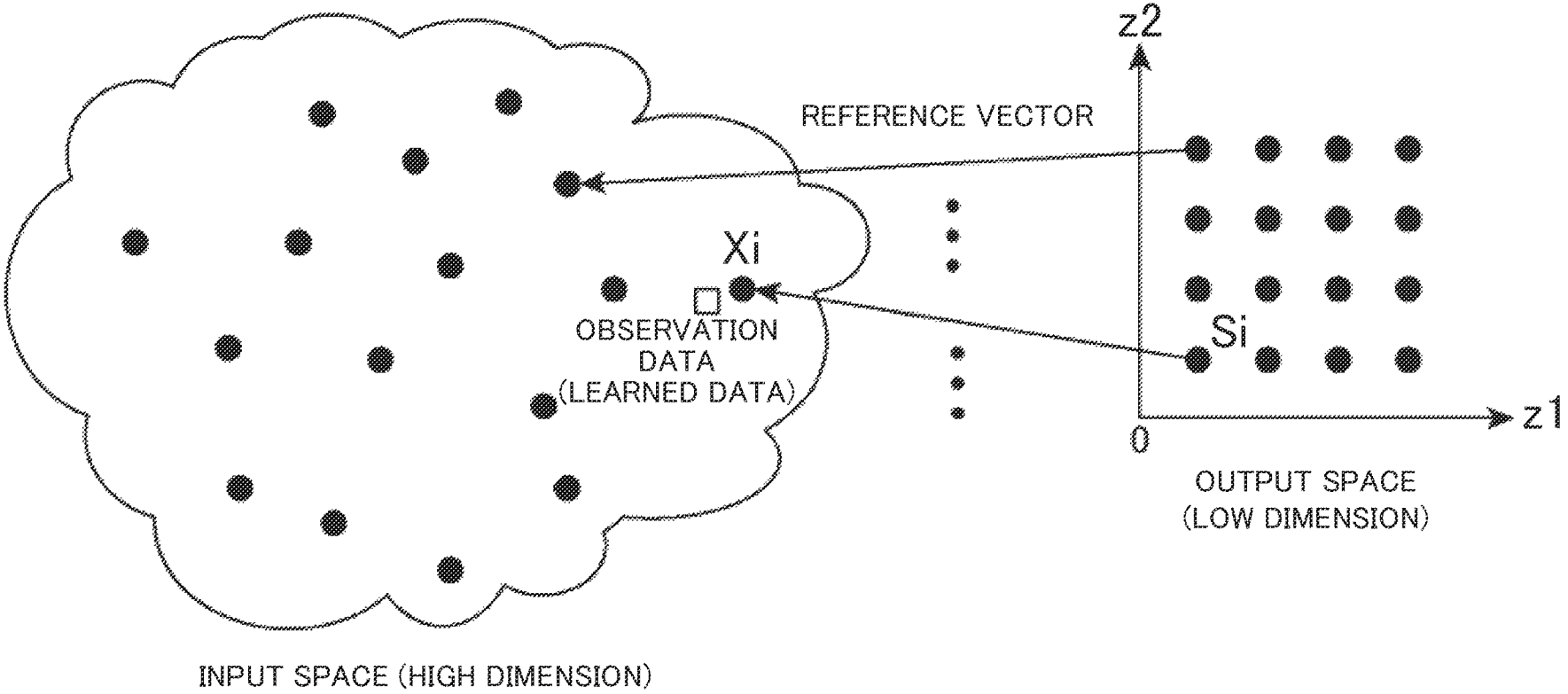
FIG. 5 is a schematic drawing for explaining machine learning of the self-organization map.

FIG. 5 is a schematic drawing for explaining the machine learning of the self-organization map SOM. As shown in FIG. 5, reference vectors are defined from the output space to the input space (space of observation data), in the self-organization map SOM. The machine learning processor 34 identifies the reference vector corresponding to the position of the observation data in the input space, on the basis of the learning data (observation data), distributes the learning amount to the reference vector and nearby reference vectors, and updates the position in the output space indicated by the reference vector, using the weighted average of the learning amount. As result, the machine learning processor 34 establishes a function for the mapping, through unsupervised machine learning.

FIG. 6 illustrates an example of the learning data used by the machine learning processor 34. As shown in FIG. 6, for example, the data acquirer 31 sequentially acquires the (normalized) observation data At to Gt, over the period from the start of use of the replaceable unit 2A to the time of replacement. The start of use and the replacement of the replaceable unit 2A are notified by the image forming apparatus 2, along with the observation data At to Gt. When the replacement of the replaceable unit 2A is detected, machine learning processor 34 acquires the residual service life (days) Rt corresponding to the observation data At to Gt of each set over the period from the start of use to the time of detection, and obtains the learning data in which the observation data At to Gt is the input data and the residual service life Rt is the output data, for example as shown in FIG. 6.

First, the machine learning processor 34 (*a*) performs the unsupervised machine learning by a known method, with respect to the neural network of the self-organization map SOM, on the basis of a plurality of sets of (normalized) observation data At to Gt. Then the machine learning processor 34 (*b*) acquires the output values of the neural network of the self-organization map SOM after the machine learning, corresponding to the plurality of sets of observation data At to Gt acquired for the machine learning, as the characteristic data, and performs the supervised machine learning of the LSTM neural network by a known method, using the combination of the characteristic data and the residual service life with respect to the plurality of sets of observation data At to Gt as the training data.

Through the mentioned machine learning, the architecture of the tiered neural network is determined, and such architecture is stored in the storage device 12, as setting data 21. The setting data 21 includes the number of hidden layers (e.g., SOM layer, LSTM layer), the number of nodes in each layer, a weighting factor (coupling coefficient) between the nodes, and the type of an output function of the node. The dimension reduction processor 32 and the residual service life calculator 33 retrieve the setting data 21, and constitute the neural network of the machine-learned self-organization map SOM and LSTM neural network. Here, the dimension reduction processor 32 and the residual service life calculator 33 may constitute the neural networks as tiered deep neural networks, including at least two hidden layers.

The request receiver 35 receives a first instruction for requesting calculation of the residual service life from the image forming apparatus 2 or the terminal device 3, via the communication device 11 (via a network), inputted by a user, such as a general user, a manager, or a service person, through the operation device 54 of the image forming apparatus 2 or the operation device 74 of the terminal device 3. When the request receiver 35 receives the first instruction, the data acquirer 31 acquires the current observation data (a1). The dimension reduction processor 32 acquires the characteristic data corresponding to the current observation data (a2). The residual service life calculator 33 acquires the residual service life from the characteristic data, and identifies the predicted value of the residual service life at the current time point (a3). (b) The request receiver 35 transmits, via the communication device 11, the predicted value of the residual service life identified as above to the image forming apparatus 2 or the terminal device 3, whichever transmitted the first instruction. The display device 53 of the image forming apparatus 2 or the display device 73 of the terminal device 3 displays the predicted value of the residual service life, to the user.

Hereunder, an operation of the residual service life prediction system 100 will be described.

(a) Machine Learning

As described above, the data acquirer 31 acquires the observation data, over the period from the start of use of the replaceable unit 2A to the replacement thereof. The machine learning processor 34 performs the machine learning on the basis of the learning data including the observation data, with respect to the neural network of the self-organization map SOM in the dimension reduction processor 32 and the LSTM neural network in the residual service life calculator 33, and stores the result of the machine learning in the storage device 12, as the setting data 21.

Here, the machine learning processor 34 may repeatedly perform the machine learning, each time the replaceable unit 2A is replaced.

(b) Acquisition of Residual Service Life Based on Request

After the machine learning, the dimension reduction processor 32 and the residual service life calculator 33 retrieve the setting data 21, and constitute the neural network of the self-organization map SOM and the LSTM neural network. When the request receiver 35 receives the first instruction, the data acquirer 31, the dimension reduction processor 32, and the residual service life calculator 33 perform the respective operations, to acquire the predicted value of the residual service life. The request receiver 35 transmits the predicted value of the residual service life, to the source of the first instruction.

(c) Acquisition of Residual Service Life of Plurality of Replaceable Units 2A In the case of predicting the residual service life of a plurality of replaceable units 2A, when the image forming apparatus 2 includes a plurality of replaceable units 2A, or when a plurality of image forming apparatuses 2 each include the replaceable unit 2A, the machine learning processor 34, the dimension reduction processor 32, and the residual service life calculator 33 can individually acquire the residual service life according to the request by the first instruction and through the machine learning, with respect to each of the plurality of replaceable units 2A.

Now, actually a large number of factors that affect the service life of the photoconductor drum 60 are involved, and therefore acquiring the residual service life, as in the existing image forming apparatus, on the basis of the values (observed values) of a few observation items (number of rotations, temperature, humidity, and so forth) may fail to provide an accurate result. On the other hand, in the case of acquiring the residual service life on the basis of many observation items, it becomes difficult to establish a formula or a lookup table, expressing the correlation between the observed value and the residual service life, because of the large number of dimensions (the number of observation items) of the observed value.

According to the first embodiment, in contrast, the dimension reduction processor 32 converts the observation data of the first number of dimensions acquired from the image forming apparatus 2, into the characteristic data of the second number of dimensions fewer than the first number of dimensions, and the residual service life calculator 33 calculates the residual service life of the replaceable unit 2A in the image forming apparatus 2, on the basis of the characteristic data.

Therefore, the mapping correlation, between the values (observed values) of many observation items that affect the service life of the replaceable unit 2A and the residual service life, can be properly established. Accordingly, the residual service life is acquired on the basis of the values (observed values) of many observation items, and consequently the residual service life can be accurately predicted.

Second Embodiment

In the residual service life prediction system 100 according to a second embodiment, the data acquirer 31, the dimension reduction processor 32, and a part of the machine learning processor 34 (engaged in the machine learning for the dimension reduction processor 32) are installed in the image forming apparatus 2, including the replaceable unit 2A the residual service life of which is to be acquired. The residual service life calculator 33 is installed in the server 1. The characteristic data is transferred from the image forming apparatus 2 to the server 1.

Figure 7:
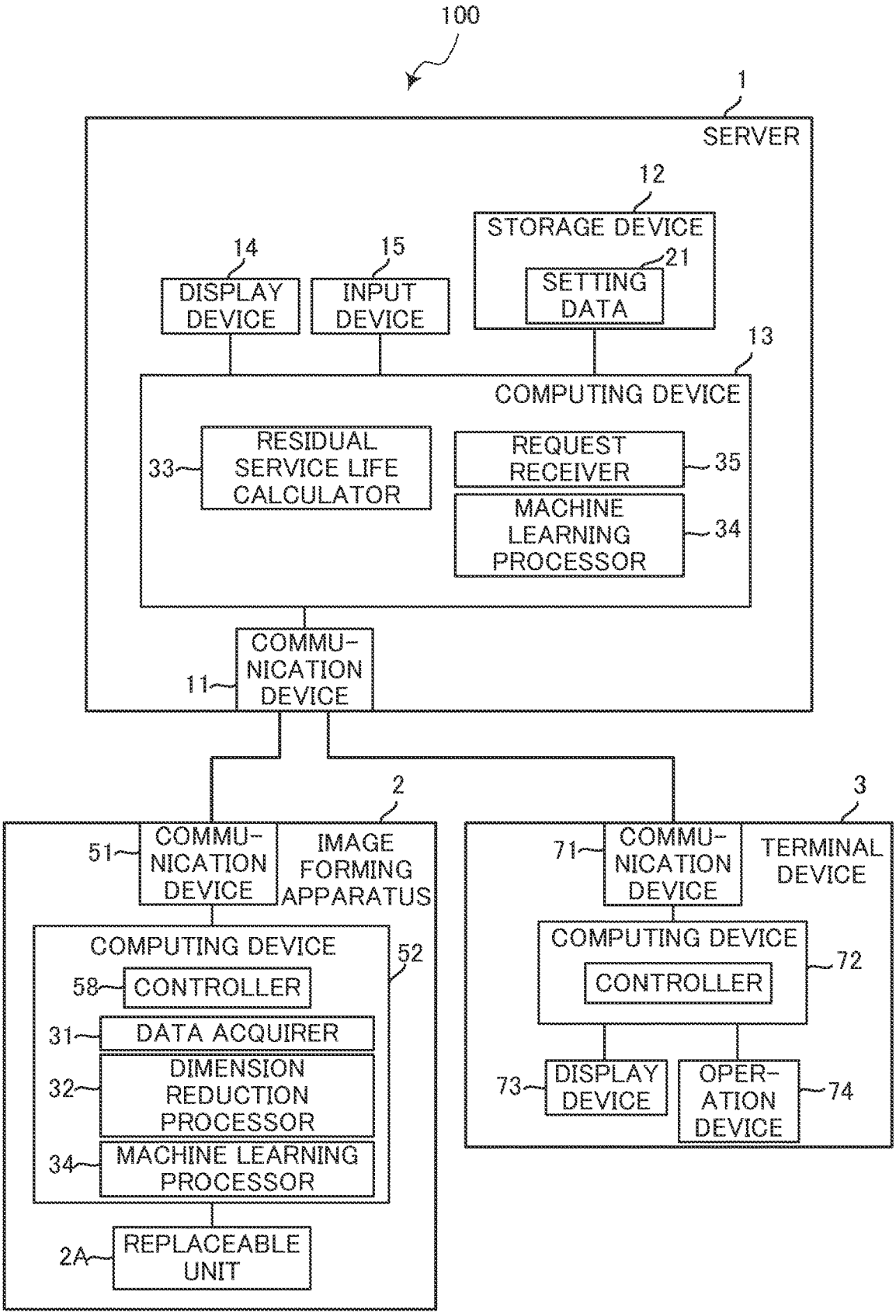
FIG. 7 is a block diagram showing a configuration of a residual service life prediction system according to a second embodiment of the disclosure.

More specifically, in the residual service life prediction system 100 according to the second embodiment, as shown in FIG. 7, the computing device 52 of the image forming apparatus 2 acts as the data acquirer 31, the dimension reduction processor 32, a part of the machine learning processor 34, and the controller 58. The data acquirer 31 acquires the observation data of the first number of dimensions. The dimension reduction processor 32 converts the observation data of the first number of dimensions into the characteristic data of the second number of dimensions. The controller 58 transmits the characteristic data to the server 1, via the communication device 51. The computing device 13 of the server 1 acts as the residual service life calculator 33, a part of the machine learning processor 34 (engaged in the machine learning for the residual service life calculator 33), and the request receiver 35. The residual service life calculator 33 acquires the characteristic data via the communication device 11, and calculates the residual service life of the replaceable unit 2A in the image forming apparatus 2, on the basis of the characteristic data.

The configurations and functions of the remaining portions of the residual service life prediction system 100 according to the second embodiment are the same as those of the first embodiment, and therefore the description will be skipped.

Third Embodiment

In the residual service life prediction system 100 according to a third embodiment, the data acquirer 31, the dimension reduction processor 32, the residual service life calculator 33, the machine learning processor 34, and the request receiver 35 are installed in the image forming apparatus 2, including the replaceable unit 2A the residual service life of which is to be acquired. Therefore, the residual service life prediction system 100 according to the third embodiment is without the server 1.

Figure 8:
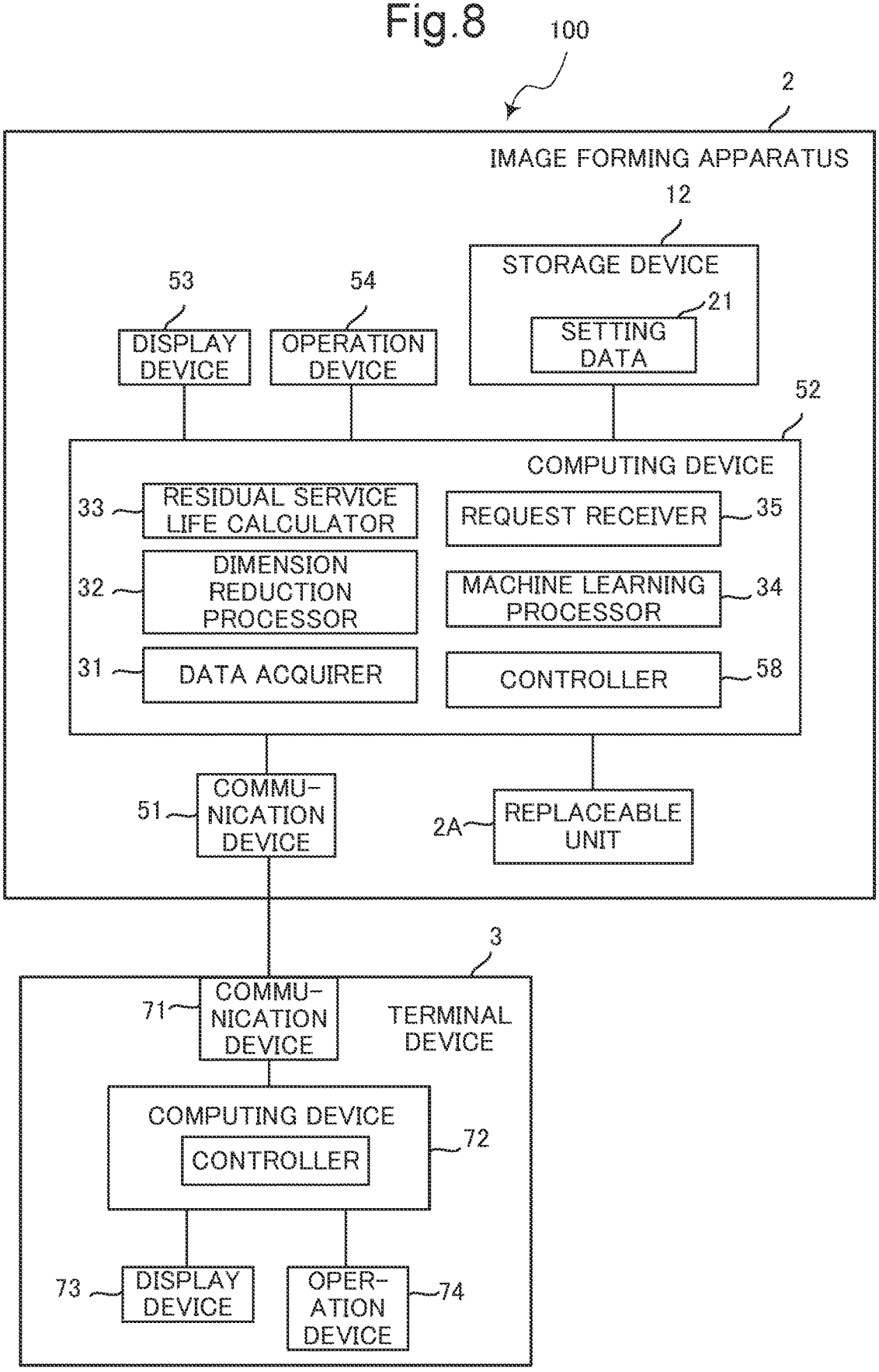
FIG. 8 is a block diagram showing a configuration of a residual service life prediction system according to a third embodiment of the disclosure.

More specifically, in the residual service life prediction system 100 according to the third embodiment, as shown in FIG. 8, the computing device 52 of the image forming apparatus 2 acts as the data acquirer 31, the dimension reduction processor 32, the residual service life calculator 33, the machine learning processor 34, the request receiver 35, and the controller 58. The data acquirer 31 acquires the observation data of the first number of dimensions. The dimension reduction processor 32 converts the observation data of the first number of dimensions into the characteristic data of the second number of dimensions. The residual service life calculator 33 calculates the residual service life of the replaceable unit 2A in the image forming apparatus 2, on the basis of the characteristic data.

In the third embodiment, the dimension reduction processor 32 and the residual service life calculator 33 are realized by an exclusive integrated circuit (IC) such as an AI chip, incorporated in the image forming apparatus 2.

The configurations and functions of the remaining portions of the residual service life prediction system 100 according to the third embodiment are the same as those of the first embodiment, and therefore the description will be skipped.

Various changes and modifications to the foregoing embodiment are obvious to those skilled in the art. Such changes and modifications may be implemented without departing from the scope and spirit of the subject, and without compromising the intended advantages. Thus, such changes and modifications are encompassed within the scope of the appended claims.

INDUSTRIAL APPLICABILITY

The disclosure is applicable to the prediction of the residual service life of, for example, the replaceable unit 2A in the image forming apparatus 2.

While the present disclosure has been described in detail with reference to the embodiments thereof, it would be apparent to those skilled in the art the various changes and modifications may be made therein within the scope defined by the appended claims.

What is claimed is:

1. A server apparatus comprising:

a first communication device that communicates with an image forming apparatus via a network; and a first computing device including a processor, and configured to act, when the processor executes a first control program, as:

a data acquirer that acquires observation data of a first number of dimensions from the image forming apparatus, via the first communication device;

a dimension reduction processor that converts the observation data of the first number of dimensions into characteristic data of a second number of dimensions fewer than the first number of dimensions; and a residual service life calculator that calculates a residual service life of a replaceable unit in the image forming apparatus, on a basis of the characteristic data.

2. A residual service life prediction system comprising:

the server apparatus according to claim 1; and the image forming apparatus, wherein the image forming apparatus includes:

a second communication device that communicates with the server apparatus via the network;

an image forming device that forms an image on a recording sheet; and a second computing device including a processor, and configured to act, when the processor executes a second control program, as a controller that transmits the observation data of the first number of dimensions to the server apparatus, via the second communication device.

3. The residual service life prediction system according to claim 2, wherein the dimension reduction processor converts the observation data into the characteristic data, using a learned neural network of a self-organization map.

4. The residual service life prediction system according to claim 3, wherein the residual service life calculator calculates the residual service life on a basis of the characteristic data, using an LSTM neural network.

5. The residual service life prediction system according to claim 2, wherein the data acquirer further acquires a plurality of sets of the observation data over a predetermined period of time, via the first communication device, and the first computing device further acts as a machine learning processor that performs machine learning of the neural network of the self-organization map and the LSTM neural network, on a basis of the plurality of sets of the observation data.

6. The residual service life prediction system according to claim 2, wherein the image forming device includes a photoconductor drum corresponding to the replaceable unit, and the data acquirer acquires, as the observation data, a plurality of observed values respectively representing a travel distance of the photoconductor drum, density gradation, density difference along an axial direction of the photoconductor drum, a coverage rate, a number of printed sheets, temperature, and humidity.

7. The residual service life prediction system according to claim 2, wherein first computing device further acts as a request receiver that receives, via the first communication device, a first instruction for requesting calculation of the residual service life transmitted from an external device, the data acquirer acquires the observation data at a current time point, when the request receiver receives the first instruction, and the request receiver transmits, via the first communication device, the residual service life at the current time point calculated by the residual service life calculator, to the external device that transmitted the request.

8. A residual service life prediction system comprising:

an image forming apparatus; and a server apparatus, wherein the image forming apparatus includes:

a first communication device that communicates with the server apparatus via a network;

an image forming device that forms an image on a recording sheet; and a first computing device including a processor, and configured act, when the processor executes a first control program, as:

a data acquirer that acquires observation data of a first number of dimensions;

a dimension reduction processor that converts the observation data of the first number of dimensions into characteristic data of a second number of dimensions fewer than the first number of dimensions; and a controller that transmits the characteristic data to the server apparatus, via the first communication device, and the server apparatus includes:

a second communication device that communicates with the image forming apparatus via the network; and a second computing device including a processor, and configured to act, when the processor executes a second control program, as a residual service life calculator that acquires the characteristic data via the second communication device, and calculates a residual service life of a replaceable unit in the image forming apparatus, on a basis of the characteristic data.

9. An image forming apparatus comprising:

an image forming device that forms an image on a recording sheet; and a computing device including a processor, and configured to act, when the processor executes a control program, as:

a data acquirer that acquires observation data of a first number of dimensions;

a dimension reduction processor that converts the observation data of the first number of dimensions into characteristic data of a second number of dimensions fewer than the first number of dimensions; and a residual service life calculator that calculates a residual service life of a replaceable unit in the image forming apparatus, on a basis of the characteristic data.

10. The image forming apparatus according to claim 9, wherein the dimension reduction processor and the residual service life calculator are realized by an exclusive IC incorporated in the image forming apparatus.

* * * * *